United States Patent [19]

Volpe

[11] Patent Number: 4,744,780

[45] Date of Patent: May 17, 1988

[54] ADAPTER BLOCK

[75] Inventor: Leo S. Volpe, Collingswood, N.J.

[73] Assignee: Tyco Industries, Inc., Moorestown, N.J.

[21] Appl. No.: 826,826

[22] Filed: Feb. 6, 1986

[51] Int. Cl.[4] ..... A63H 33/08; A63H 33/06

[52] U.S. Cl. ..... 446/128; 446/121; 403/300

[58] Field of Search ..... 446/120, 128, 111, 126, 446/125, 121; 403/300, 305

[56] References Cited

U.S. PATENT DOCUMENTS

| | | | |
|---|---|---|---|
| 906,228 | 12/1908 | Hervey | 403/305 X |
| 3,005,282 | 10/1961 | Christiansen | 446/128 |
| 3,086,629 | 4/1963 | Blitzer | 446/125 X |
| 3,233,358 | 2/1966 | Dehm | 446/128 X |
| 3,234,683 | 2/1966 | Christiansen | 446/128 X |
| 3,236,004 | 2/1966 | Christiansen | 446/128 X |
| 3,415,007 | 12/1968 | Höwe | 446/128 X |
| 3,597,875 | 8/1971 | Christiansen | 446/128 |
| 3,611,621 | 10/1971 | Folson | 446/125 |
| 4,129,960 | 12/1978 | Gale | 446/128 |
| 4,306,372 | 12/1981 | Lin | 446/128 X |
| 4,522,001 | 6/1985 | Meyer | 446/128 X |

FOREIGN PATENT DOCUMENTS

| | | | |
|---|---|---|---|
| 229861 | 10/1958 | Australia | 446/128 |
| 550406 | 12/1957 | Canada | 446/128 |
| 629732 | 10/1961 | Canada | 446/128 |
| 702336 | 1/1965 | Canada | 446/120 |
| 1150976 | 1/1958 | France | 446/128 |
| 1206687 | 2/1960 | France | 446/128 |
| 1339661 | 9/1963 | France | 446/128 |
| 8200595 | 3/1982 | PCT Int'l Appl. | 446/128 |

*Primary Examiner*—Robert A. Hafer
*Assistant Examiner*—D. Neal Muir
*Attorney, Agent, or Firm*—Panitch Schwarze Jacobs and Nadel

[57] ABSTRACT

An adapter for interconnecting hollow toy building blocks having a generally cylindrical primary projection extending outwardly therefrom comprises a housing which is generally square in cross section, having two interconnected pairs of generally parallel sidewalls defining first and second open ends for receiving the blocks to be interconnected. The adapter further includes one generally cylindrical tubular member substantially within the center of the housing, the cylindrical tubular member extending generally parallel to the sidewalls and being supported by at least one flange member extending inwardly from one of the sidewalls, the flange member being generally parallel to and of substantially the same height as the sidewalls. The projections on the blocks to be interconnected are inserted into the space between the sidewalls and the cylindrical tubular member from each end, respectively, so that the sidewalls and cylindrical tubular member cooperate to grip and hold the projection to interconnect the two blocks facing each other.

2 Claims, 4 Drawing Sheets

FIG. 30
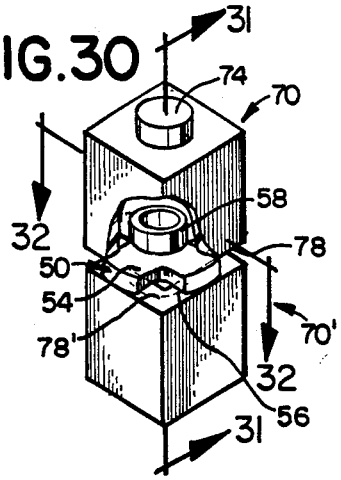
FIG. 31
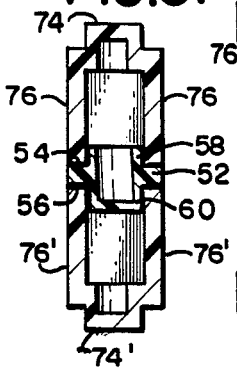
FIG. 32
FIG. 33
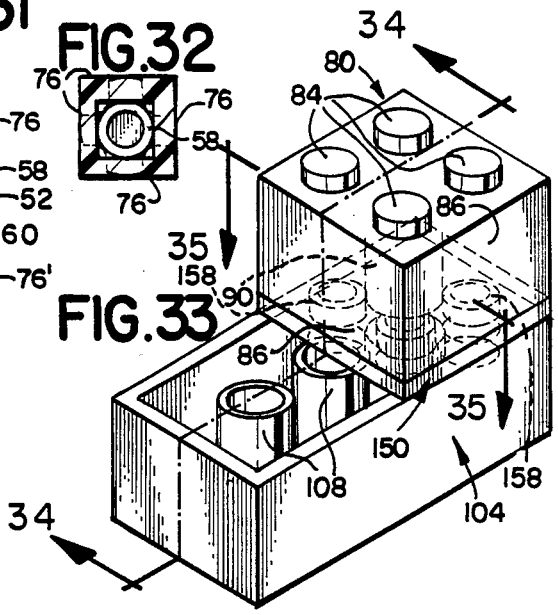
FIG. 34
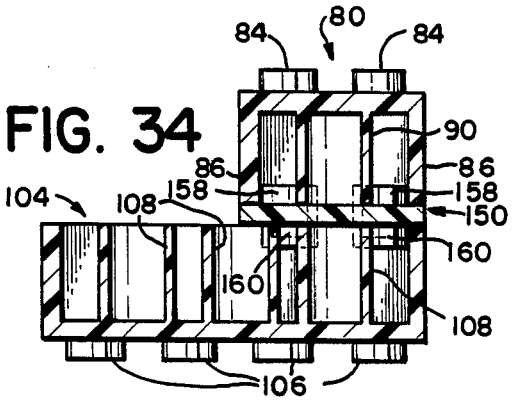
FIG. 35
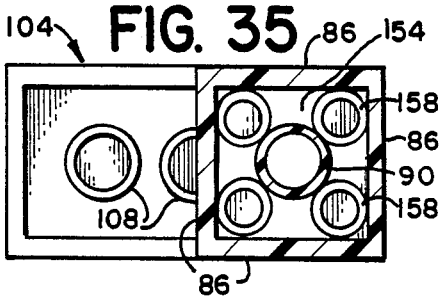
FIG. 36
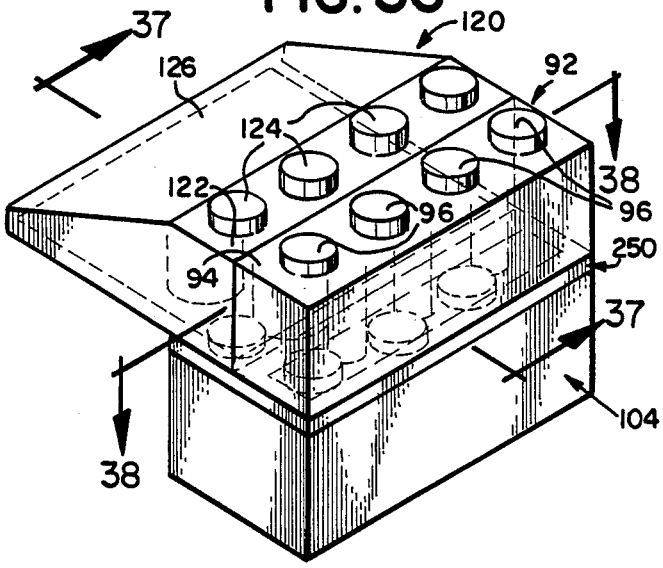
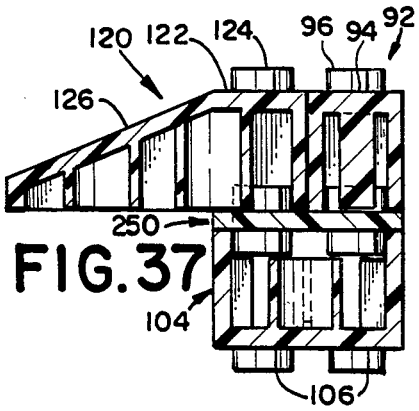
FIG. 37

ADAPTER BLOCK

BACKGROUND OF THE INVENTION

The present invention relates generally to toy building blocks and, more particularly, to an adapter or adapter block which may be utilized for interconnecting toy building blocks in an orientation which is opposite to the orientation in which the blocks are usually or normally interconnected.

Toy building blocks have been shown to be helpful in developing hand and eye coordination, as well as in developing small muscle coordination in children. In addition, building blocks provide a source of amusement for children, as well as providing a sense of pride in accomplishing the building of a particular structure out of the blocks.

One type of building block which has become very popular with both younger and older children, as well as with adults, are hollow plastic toy building blocks having studs, projections or turrets on one end and having openings for receiving the turrets on the other end, permitting the turrets from one block to be inserted into the open end of another block for temporarily interconnecting the two blocks together with a gripping force. Such blocks are shown and described in expired U.S. Pat. No. 3,005,282. The blocks shown in this patent are commercially available from a variety of manufacturers in a large variety of shapes, sizes and colors. The manufacturers also provide a variety of specialized blocks, including blocks having particular angles, clear plastic blocks for forming windows, windshields, etc., doors, angled roof blocks and the like. As a result, the structures which could be created are limited only by the mind of the particular user.

While the use of such plastic blocks provide great flexibility, there is one other substantial limitation on the use of these blocks. That limitation is that the blocks must be interconnected in a single orientation in which a first or top end of one block which contains the generally cylindrical primary projections or turrets engages the open bottom end of a second block, the sidewalls and/or a tubular secondary projection within the second block gripping the primary turrets on the first block for holding the two blocks together. In the present application, the interconnection of the blocks in this manner is referred to as the "normal" manner of interconnecting the blocks. Thus, with the blocks of this type, it is not possible to interconnect the bottom ends of two blocks to each other, nor is it possible to interconnect the first or top ends of two blocks together. Of course, such a limitation is of no importance with respect to the standard or regular square or rectangular building blocks of the type shown and described in the aforesaid patent since, once the blocks are interconnected, the outward appearance of the blocks is the same regardless of the orientation in which the blocks are connected. However, this limitation becomes important in the case of some of the specialty blocks, for example the roof blocks of the type shown in expired U.S. Pat. No. 3,034,254, as well as other specialty blocks having irregular or unusual shapes. In building some structures, it may be desirable to have the ability to place such roof blocks or other specialty blocks in the structure with an orientation other than the normal orientation. Orienting the roof blocks and specialty blocks in this manner is not possible with the prior art building blocks, because the blocks can only be interconnected in the normal manner as described above.

The present invention comprises an adapter or adapter block, which allows hollow plastic toy building blocks of the type discussed above to be interconnected with an orientation which is opposite the orientation required for normal interconection. One embodiment of the present invention permits the first or top end of one toy building block to be interconnected top to top with the first or top end of another toy building block, so that the top or first ends of the two blocks are facing each other. Another embodiment of the present invention permits the second end or open bottom end of one toy buiding block to be interconnected bottom to bottom with the second end or open bottom end of another toy building block, so that the open bottom ends are facing each other.

SUMMARY OF THE INVENTION

Briefly stated, the present invention comprises an adapter for interconnecting hollow toy building blocks, each block including a first end having an end wall with an inner surface and an outer surface which includes one generally cylindrical primary projection extending outwardly therefrom and sidewalls extending generally outwardly from and encompassing the inner surface to define a second generally open end. Some of the blocks include at least one generally cylindrical secondary projection extending generally outwardly from the inner surface of the first end wall. The blocks are normally interconnected with the first end of one block engaging the second end of another block, the primary projection of the one block extending into the open second end of the other block and engaging at least one of the sidewalls, the second projection, or both on the other block to provide a gripping force for holding the blocks together.

The adapter, in one embodiment, comprises a generally flat base member having first and second surfaces on opposite ends thereof. A first generally cylindrical projection extends generally perpendicularly outwardly from the first surface of the base member and a second generally cylindrical projection extends generally perpendicularly outwardly from the second surface of the base member. In use, the first surface of the base member is adapted for engaging the open second end of one block with the first base member projection extending into the open second end of the one block and engaging at least one of the sidewalls, the secondary projection, or both on the one block. The second surface of the base member is adapted for engaging the open second end of another block with the second base member projection extending into the open second end of the other block and engaging at least one of the sidewalls, the secondary projection, or both on the other block to interconnect the two blocks with their respective open second ends facing each other.

In another embodiment, the adapter comprises a parallelepiped shaped housing having walls and including at least two interconnected pairs of generally parallel sidewalls defining first and second generally open ends. The sidewalls have a height not less than twice the height of the primary projections on the blocks. In use, a first end of the adapter engages the first end wall of one block with the primary projection on the one block extending into the adapter and engaging at least two of the walls. The second end of the adapter engages the first end wall of another block with the primary projection on the other block extending into the housing and engaging at least two of the walls to interconnect the blocks with their respective first end walls facing each other.

BRIEF DESCRIPTION OF THE DRAWINGS

The foregoing summary, as well as the following detailed description, will be better understood when read in conjunction with the appended drawings. For the purpose of illustrating the invention, there is shown in the drawings embodiments which are presently preferred, it being understood, however, that this invention is not limited to the precise arrangements and instrumentalities shown. In the drawings:

FIG. 30 is a top perspective view, partially broken away, of two of the blocks of FIG. 11 interconnected by the adapter block of FIG. 1;

FIG. 31 is a sectional view of the interconnected blocks of FIG. 30 taken along line 31—31 of FIG. 30;

FIG. 32 is a sectional view of the interconnected blocks of FIG. 30 taken along line 32—32 of FIG. 30;

FIG. 33 is a top perspective view showing the block of FIG. 13 interconnected with the block of FIG. 22 utilizing the adapter block of FIG. 4;

FIG. 34 is a sectional view of the interconnected blocks of FIG. 33 taken along line 34—34 of FIG. 33;

FIG. 35 is a sectional viw of the interconnected blocks of FIG. 33 taken along line 35—35 of FIG. 33;

FIG. 36 is a top perspective view of the blocks of FIGS. 16 and 25 interconnected with the block of FIG. 22 utilizing the adapter block of FIG. 8;

FIG. 37 is a sectional view of the interconnected blocks of FIG. 36 taken along line 37—37 of FIG. 36;

DESCRIPTION OF PREFERRED EMBODIMENTS

Figure 1:
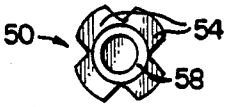
FIG. 1 is a top plan view of a first embodiment of an adapter block in accordance with the present invention.
Figure 2:
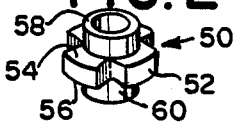
FIG. 2 is a top perspective view of the adapter block of FIG. 1.
Figure 3:
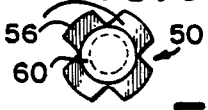
FIG. 3 is a bottom plan view of the adapter block of FIG. 1.

Referring in detail to the drawings, wherein like numerals indicate like elements throughout, there is shown in FIGS. 1, 2 and 3 an adapter or adapter block 50 in accordance with a first embodiment of the present invention. The adapter block 50 is comprised of a generally flat base member 52 having a first or top surface 54 on one end and a second or bottom surface 56 on the opposite end. In the embodiment shown in FIGS. 1 through 3, the generally flat base member 52 is generally plus-shaped in plan view. However, the base member could be square, round or any other desirable shape. In the embodiment shown, the thickness or height of the base member 52 (the distance between the first surface 54 and the second surface 56) is small relative to the overall thickness or height of the adapter block 50. However, it should be appreciate by those skilled in the art that the present invention is not limited to a base member having a particular height or thickness and that the height or thickness of the base member 52 could be much larger in comparison to the overall height of the adapter block 50.

The adapter block 50 further includes a first generally cylindrical projection, turret or stud 58 extending generally perpendicularly outwardly or upwardly from the first surface 54 of the base member 52. For reasons which will hereinafter become apparent, the first base member projection 58 is substantially the same size as the primary projections on the blocks with which the adapter block 50 is employed. Similarly, as will also hereinafter become apparent, the height of the first cylindrical projection 58 is substantially the same as the height of the primary projections on the blocks with which the adapter block 50 is employed. In the presently preferred embodiment, the first projection 58 on the first base member surface 54 is generally tubular. Such a tubular projection affords flexibility in utilizing the adapter block 50 in that appropriate cylindrical members such as a flag pole (not shown) or the like could be inserted and retained within the central portion of the projection 58.

The adapter block 50 also includes a second generally cylindrical projection, turret or stud 60 extending generally perpendicularly outwardly or downwardly from the second surface 56 of the base member 52. In the presently preferred embodiment as shown in FIGS. 2 and 3, the second base member projection 60 is substantially the same size as the first base member projection 58. In addition, in the presently preferred embodiment, the second base member projection 60 extends outwardly from the base member 52 substantially the same distance as the first base member projection 58. However, it should be appreciate by those skilled in the art that the second base member projection may be of a different size or may extend outwardly from the base member 52 by a greater or lesser distance if desired.

In the presently preferred embodiment, the second base member projection 60 is generally aligned with the first base member projection 58 in that the two cylindrical projections 58 and 60 share a common axis (not shown). It will also be appreciate by those skilled in the art that the second base member projection 60 could be offset from the presently preferred position so that the two projections 58 and 60 are not generally aligned. If desired, the second base member projection 60 could also be generally tubular (not shown).

Figure 11:
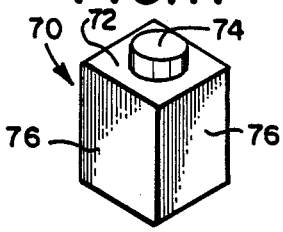
FIG. 11 is a top perspective view of a 1×1 toy building block having a single primary turret or projection on the top end.
Figure 12:
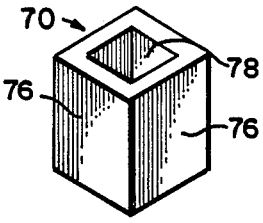
FIG. 12 is a bottom perspective view of the toy building block of FIG. 11.

Before discussing the use of the adapter block 50, it is necessary to briefly describe the hollow toy building blocks with which the adapter block 50 is used. Referring now to FIGS. 11 and 12, there is shown a simple hollow toy building block 70. The block has a first or top end having a generally square, generally flat end wall 72. The end wall 72 has an inner surface (not shown) and an outer surface. A generally cylindrical primary projection or stud 74 extends generally perpendicularly outwardly or upwardly from the outer surface of the end wall 72. The primary projection 74 is generally centrally located on the first end wall 72. Four sidewalls 76 extend generally outwardly or downwardly from the end wall 72, generally encompassing the inner surface of the end wall 72. The sidewalls 76 are all of the same length and define a second generally open or bottom end 78 of the block 70. The diameter of the primary projection 74 is slightly greater than the distance between the inner surfaces of the sidewalls 76. Two of the blocks 70 are usually or normally interconnected (not shown) with the first end of one block engaging the second end of the other block so that the primary projection 74 on the top of the one block extends into the open second or bottom end 78 on the other block. Since the diameter of the primary projection 74 of the one block is slightly greater than the distance between the sidewalls 76 on the other block, the sidewalls 76 on the other block tightly engage the inserted primary projection 74 to provide a gripping force for holding the two blocks together.

The block 70 shown in FIGS. 11 and 12 constitutes the simplest form of the toy building blocks to which the present invention pertains. The block 70 is sometimes referred to as a 1×1 block, because its length and width are each a single building block unit. Substantially all of the other standard or regularly shaped toy building blocks can be described in terms of multiples of the unitary size block 70.

Figure 13:
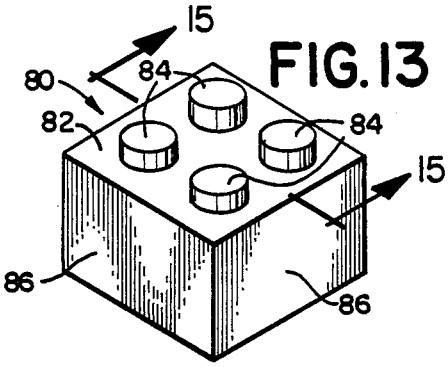
FIG. 13 is a top perspective view of a 2×2 toy building block having four primary turrets on the top end.
Figure 15:
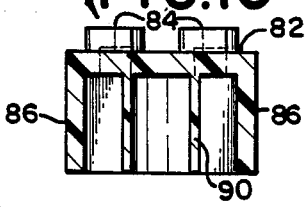
FIG. 15 is a sectional view of the 2×2 block taken along line 15—15 of FIG. 13.
Figure 14:
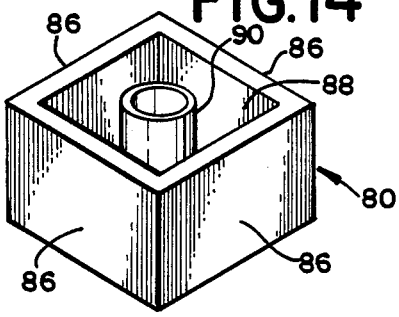
FIG. 14 is a bottom perspective view of the toy building block of FIG. 13.

FIGS. 13, 14 and 15 show a standard 2×2 toy building block 80. Block 80 includes a generally square first or top end wall 82 with four primary projections 84 extending outwardly therefrom. Block 80 also includes four sidewalls 86 which define the generally open second or bottom end 88. Block 80 further includes a generally cylindrical secondary projection or stud 90 extending generally perpendicularly downwardly from the inner surface of the first end wall 82 and generally parallel to the sidewalls 86. In the embodiment shown in FIGS. 13, 14 and 15, the secondary projection 90 is generally tubular and is located in the center of the first end wall 82.

The 2×2 blocks 80 are normally or usually interconnected in substantially the same manner as the 1×1 block 70. However, because of the size of the 2×2 block 80, the primary projections 84 on one block do not contact all of the sidewalls 86 of the other block. Instead, each primary projection 84 contacts two of the sidewalls 86 and the secondary projection 90 on the other block. Of course, the secondary projection 90 is sized so that the space within which each primary projection 84 on the one block fits is slightly smaller than the overall size of the primary projections 84 to provide a gripping force for holding the blocks together.

Figure 18:
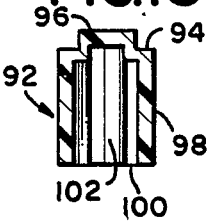
FIG. 18 is a sectional view of the 1×4 building block taken along line 18—18 of FIG. 17.
Figure 16:
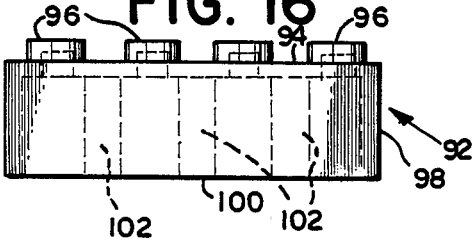
FIG. 16 is a front elevational view of a 1×4 toy building block having four primary turrets on the top end.
Figure 17:
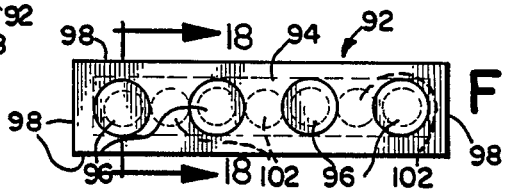
FIG. 17 is a top plan view of the toy building block of FIG. 16.

FIGS. 16, 17 and 18 show a standard 1×4 block 92. The 1×4 block 92 includes a generally rectangular first or top end wall 94 and four generally cylindrical outwardly or upwardly extending primary projections 96. The 1×4 block includes sidewalls 98 which define a generally open second or bottom end 100. Three outwardly or downwardly extending generally cylindrical secondary projections 102 are disposed within the interior of the block 92. Interconnection of the 1×4 block 92 with the other blocks is accomplished in substantially the same manner as previously described above.

Figure 22:
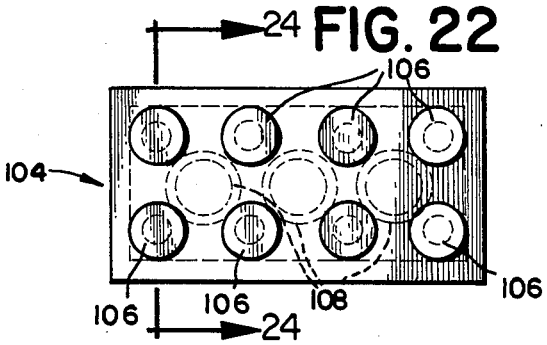
FIG. 22 is a top plan view of a second type of 2×4 toy building block having eight primary turrets on the top end.
Figure 23:
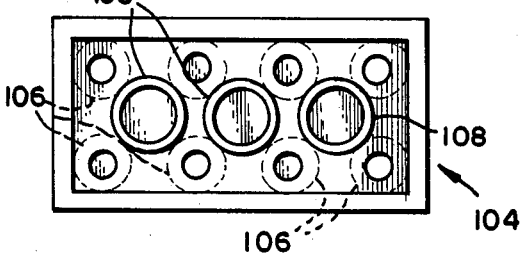
FIG. 23 is a bottom plan view of the toy building block of FIG. 22.
Figure 24:
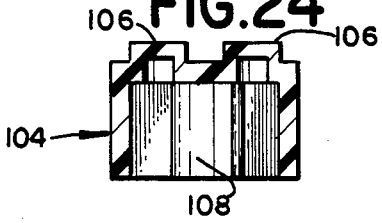
FIG. 24 is a sectional view of the 2×4 toy building block of FIG. 22 taken along line 24—24 of FIG. 22.
Figure 25:
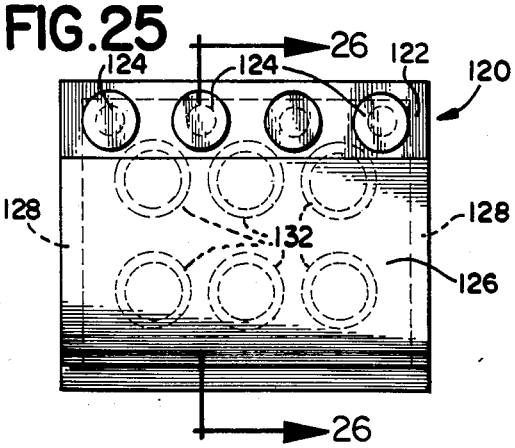
FIG. 25 is a top plan view of an angled roof toy building block.

FIGS. 22, 23 and 24 show a standard 2×4 block having eight primary projections 106 positioned in two generally parallel spaced rows and three spaced, generally tubular secondary projections 108. Again, block 104 interconnects with other blocks in substantially the same manner as previously described.

Figure 19:
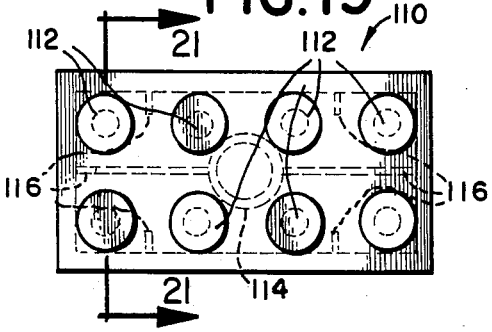
FIG. 19 is a top plan view of a first type of 2×4 toy building block.
Figure 20:
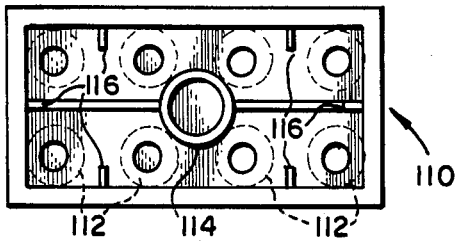
FIG. 20 is a bottom plan view of the toy building block of FIG. 19.
Figure 21:
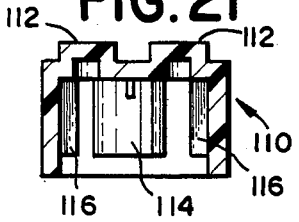
FIG. 21 is a sectional view of the 2×4 toy building block of FIG. 19 taken along line 21—21 of FIG. 19.

FIGS. 19, 20 and 21 show a specialized 2×4 block 110 having eight primary projections 112 substantially the same as those of the standard or regular 2×4 block 104. However, the special 2×4 block 110 has only a single secondary projection 114 which is not the same length as the secondary projections 106 on the standard or regular 2×4 block 104. The special 2×4 block 110 also includes a plurality of ribs 116 extending generally inwardly from the block sidewalls. The specialized 2×4 block is interconnected with other blocks substantially as described above when the blocks are connected with the primary projections 112 of the specialized block extending into the open second end of the other block. When the blocks are interconnected in the reverse manner, the primary projections on the other block engage only the sidewalls on the specialized 2×4 block 110.

Figure 26:
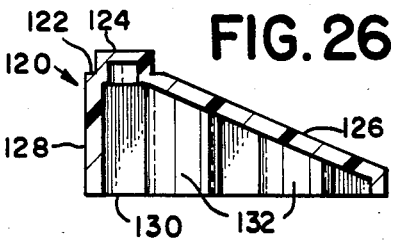
FIG. 26 is a sectional view of the roof toy building block taken along line 26—26 of FIG. 25.
Figure 27:
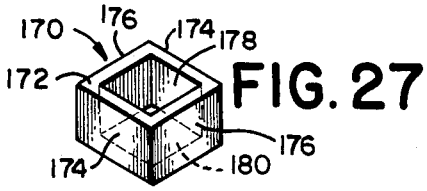
FIG. 27 is a top perspective view of an adapter block in accordance with a second embodiment of the present invention.

FIGS. 26 and 27 show a regular or standard roof block 120. The roof block 120 which is shown and described in the aforementioned expired U.S. Pat. No. 3,034,254 includes a first generally rectangular top or end wall 122 with four primary projections 124 extending outwardly therefrom. An inclined wall 126 extends generally downwardly from the end wall 122. Four sidewalls 128 define the generally open second or bottom end 130 of the roof block. Six secondary projections 132 extend outwardly or downwardly from the end wall 122 and the inclined wall 126 as shown. The roof block 120 is normally interconnected with other blocks in substantially the same manner as described above in connection with the standard 2×2 block.

The six standard toy building blocks which are shown in FIGS. 11 through 26 and which have been briefly described above are typical examples of the toy building blocks with which the present invention is utilized. Of course, there are many variations of the six standard blocks which are available and could also utilize the adapter block of the present invention. For example, there are blocks which are more elongated forms of the 1×4 block shown in FIGS. 16 through 18, for example 1×10 blocks (not shown). Similarly, there are larger versions of the standard 2×4 block shown in FIGS. 22 through 24, for example a standard 10×10 base block (not shown). In addition, there are many specialty blocks having irregular shapes with which the present invention could also be employed. As previously discussed, these toy building blocks can generally be interconnected only in a single manner, the top end of one block engaging the bottom end of another block. The present invention facilitates interconnection of toy building blocks with a different orientation, i.e., bottom to bottom or top to top. Essentially, the present invention can be employed with any such blocks which include a primary projection on the top or first end and a generally open bottom end and which are normally or usually interconnected in the manner described above.

FIGS. 30, 31 and 32 show two standard 1×1 blocks which have been interconnected with their bottom or second open ends facing each other utilizing the bottom to bottom adapter block 50. For the purpose of describing the relationship between the blocks, the top 1×1 block 70 will be given the same reference numerals as used in connection with FIGS. 11 and 12 and the bottom 1×1 block 70' will be given the same reference numerals, but with the addition of primes.

The first surface 54 of the base member 52 engages the open second end 78 on the upper block 70 with the first base member projection 58 extending into the open second end 78 of block 70. Since the outside diameter of the first base member projection 58 is slightly greater than the distance between the interior surfaces of the block sidewalls 76, the sidewalls 76 engage and grip the first base member projection 58 thereby holding the adapter block 50 in place. Similarly, the second surface 56 of the base member 52 engages the open second end 78' of the lower block 70' with the second base member projection 60 extending into the open second end 78' of the lower block 70'. The sidewalls 76' engage and grip the second base member projection 60 to secure the lower block 70' to the adapter block 50, thereby interconnecting the two blocks 70 and 70' bottom to bottom with their respective open second ends 78 and 78' facing each other. Of course, the blocks 70 and 70' can be separated from each other and from the adapter block 50 by merely pulling them apart, since the gripping force provided, while sufficient for temporarily holding the blocks together is not so great as to preclude the blocks from being later separated if desired.

Figure 4:
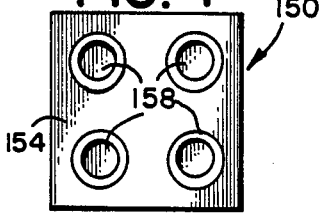
FIG. 4 is a top plan view of a first variation of the adapter block of FIG. 1.
Figure 5:
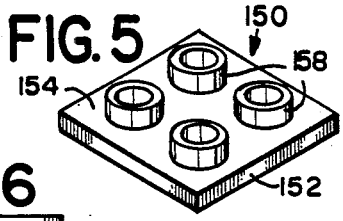
FIG. 5 is a top perspective view of the adapter block of FIG. 4.
Figure 6:
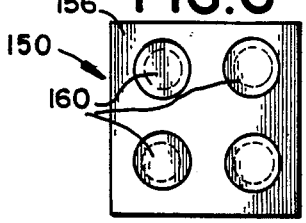
FIG. 6 is a bottom plan view of the adapter block of FIG. 4.

The basic concept of the bottom to bottom adapter block 50 for permitting the interconnection of the second or bottom ends of standard blocks together (bottom to bottom) in accordance with a first embodiment of the present invention has been described in detail. There are many variations of the adapter block 50 which would be apparent to one skilled in the art. For example, FIGS. 4, 5 and 6 show a bottom to bottom adapter block 150 which is a first variation of adapter block 50. Adapter block 150 is comprised of a generally flat base member 152 which is generally square in plan view. The base member 152 also has a first or top surface 154 on one end and a second or bottom surface 156 on the opposite end. Extending generally perpendicularly outwardly from the first surface 154 is a first set of four generally cylindrical projections 158. The projections 158 which are shown as being generally tubular are arranged in two generally parallel rows with the projections in each row being spaced apart a distance substantially equal to the distance between the rows. The projections 158 are substantially the same size and height as projection 58. The distance between the outer dimension of the two projections 158 in a single row is at least slightly greater than the distance between the inner surfaces of the sidewalls 86 of a standard 2×2 block 80. The second or bottom surface 156 has a second set of four generally cylindrical projections 160 extending generally perpendicularly outwardly therefrom. As shown in FIGS. 4–6, the projections 160 of the second set are generally the same size and height as those of the first set 158 and are generally aligned with the projections of the first set 158 along a common axis line (not shown). However, the projections 160 of the second set could be of a different size and/or could be offset from the projections 158 of the first set.

FIGS. 33, 34 and 35 illustrate the use of a 2×2 adapter block 150 for interconnecting, bottom to bottom, a standard 2×2 block 80 and a standard 2×4 block 104. The first or upper surface 154 of the adapter block 150 engages the second open end 88 of the 2×2 block 80 with the first set of projections 158 extending into the second open end 88. Each of the projections 158 engages two of the sidewalls 86, as well as the secondary projections 90 of the 2×2 block 80 to provide the gripping force for holding together the adapter block 150 and the 2×2 block 80.

Similarly, the second or bottom surface 156 of the adapter block 150 engages the generally open second end of the 2×4 block 104 with the second set of projections 160 extending therein. Two of the projections 160 engage the sidewalls of the 2×4 block 104 and one of the secondary projections 108. The other two projections 160 engage two of the secondary projections 108 and one of the sidewalls of the 2×4 block 104. In this manner, the second set of base member projections 160 is gripped by the 2×4 block 104 to interconnect the 2×2 block 80 with the 2×4 block 104 bottom to bottom, with their second open ends facing each other.

Figure 7:
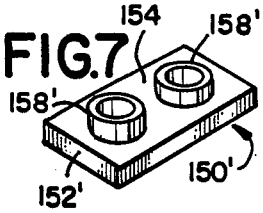
FIG. 7 is a top perspective view of an adapter block which is a second variation of the adapter block of FIG. 1.

Referring now to FIG. 7, there is shown an adapter block 150' which is a second variation of the first embodiment of the present invention. The adapter block 150' is a 1×2 adapter block which is substantially one half of the adapter block 150 of FIGS. 4, 5 and 6. Adapter block 150' includes a generally rectangularly shaped base member 152' having an upper surface 154' with a first set of two spaced generally cylindrical projections 158' extending perpendicularly outwardly along a single row. An opposite second surface (not shown) also includes two spaced generally cylindrical projections (not shown) extending outwardly therefrom and aligned with the first set of projections 158'. The 1×2 bottom to bottom adapter block 150' is utilized in substantially the same manner as is illustrated in FIGS. 33, 34 and 35 for the 2×4 adapter block 150.

Figure 8:
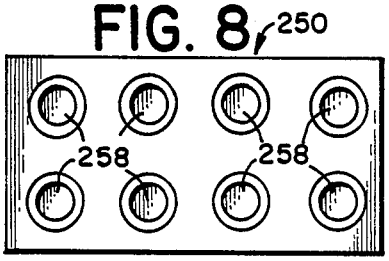
FIG. 8 is a top plan view of an adapter block which is a third variation of the adapter block of FIG. 1.
Figure 9:
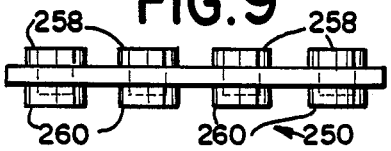
FIG. 9 is a front elevational view of the adapter block of FIG. 8.
Figure 10:
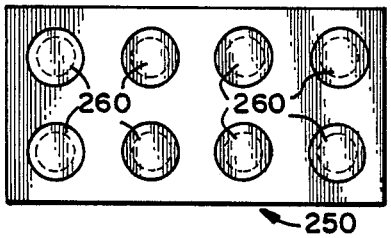
FIG. 10 is a bottom plan view of the adapter block of FIG. 8.

FIGS. 8, 9 and 10 illustrate a 2×4 bottom to bottom adapter block 250 which constitutes a third variation of the first embodiment of the present invention. The 2×4 adapter block 250 is substantially the same as two 2×2 adapter blocks 150 attached end to end. Therefore, a complete description of the structure of the 2×4 adapter block 250 is not necessary.

Figure 38:
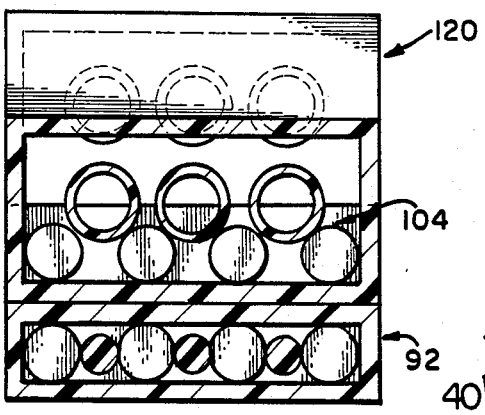
FIG. 38 is a sectional view of the interconnected blocks of FIG. 36 taken along line 38—38 of FIG. 36.

The use of the 2×4 adapter block 250 in interconnecting a standard 2×4 block 106 with a standard roof block 120 and a standard 1×4 block 92 is shown in FIGS. 36, 37 and 38. Again, the 2×4 adapter block 250 is employed in substantially the same manner as the 2×2 adapter block 150 discussed above in connection with the description relating to FIGS. 33, 34 and 35. A complete explanation of the use of the 2×4 adapter block is therefore not necessary.

From the foregoing description, it can be seen that the first embodiment of the present invention comprises an adapter block which permits the bottom-to-bottom interconnection of toy building blocks of virtually any standard or non-standard shape. All that is required is that the second or bottom ends of the building blocks are generally open, are of the proper dimension and, if applicable, include the secondary projections. The adapter blocks may be of a single or unitary size, such as 1×1 adapter block 50 of FIGS. 1 through 3, or may be of a greater size, such as the adapter blocks shown in FIGS. 4 through 10. Likewise, the adapter block may be of any other desired size and/or shape, as long as the adapter block includes a first projection or projections on one surface and a second projection or projections on the opposite surface, and as long as the projections are properly sized, shaped and spaced to conform to the matrix of the toy building blocks.

It is also desirable to have the ability to interconnect two toy building blocks top to top, with their first ends facing each other. Accordingly, referring to FIG. 27, there is shown an adapter block 170 in accordance with a second embodiment of the present invention. The adapter block 170 is comprised of a generally parallelepiped shaped housing 172 having walls including two interconnected pairs of generally parallel sidewalls 174 and 176, respectively, to define generally open first or top and second or bottom ends 178 and 180, respectively. For purposes which will hereinafter become apparent, the height of the sidewalls 174 and 176 is not less than twice the height of the primary projections 74, 84, 96, 106, 112, and 124 on the toy building blocks. Preferably, the sidewalls 174 and 176 have a height which is substantially one half of the height of a standard toy building block. The distance between the sidewalls 174 and 176 of each pair is slightly less than the diameter of the primary projections on the toy building blocks.

Figure 42:
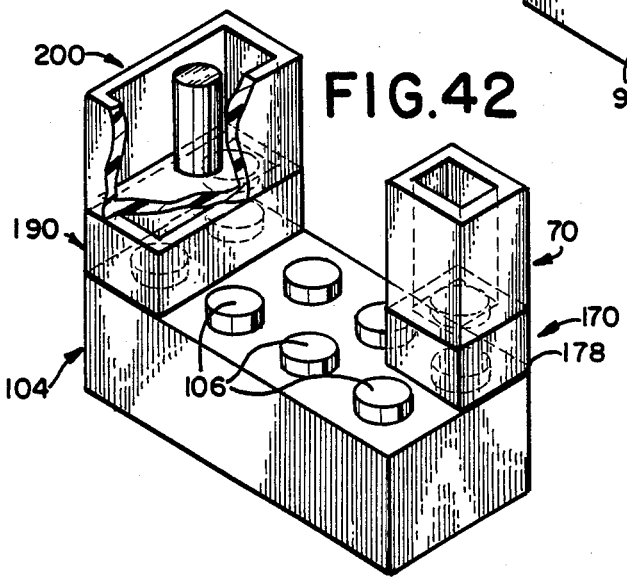
FIG. 42 is a top perspective view showing the block of FIG. 22 interconnected with the block of FIG. 11 and a 1×2 toy building block (partially broken away) utilizing the adapter blocks of FIGS. 27 and 28, respectively.

FIG. 42 shows the 1×1 top-to-top adapter block 170 in use for interconnecting a standard 1×1 block 70 with a standard 2×4 block 104. As shown, the first or top housing end 178 engages the first or top end wall of the 2×4 block 104 with one of the primary projections 106 extending into the adapter block 170 and engaging the sidewalls 174 and 176. As previously described, the distance between the interior surfaces of the sidewalls 174 and 176 is at least slightly less than the diameter of the primary projection 106 on the 2×4 block 104 to provide a gripping force for interconnecting the adapter block 170 to the 2×4 block 104. Similarly, the first or top surface 72 of the 1×1 block 70 engages the open second end 180 of the adapter block 170 with the primary projection 74 extending into the adapter block 170. The adapter block sidewalls 174 and 176 thus grip the primary projection 74 thereby interconnecting the 1×1 block 70 with the 2×4 block 104 with their respective first or top end walls facing each other.

Figure 28:
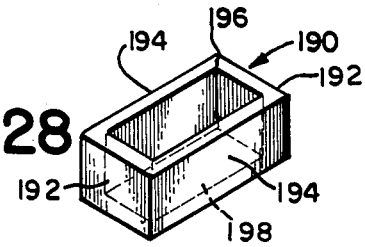
FIG. 28 is a top perspective view of an adapter block which is a first variation of the block of FIG. 27.

FIG. 28 illustrates a 1×2 top-to-top adapter block 190 which is a first variation of the adapter block 170 of FIG. 27. Adapter block 190 is similar to adapter block 170 in that it includes two interconnected pairs of generally parallel sidewalls 192 and 194 which define first and second generally open ends 196 and 198, respectively. However, unlike adapter block 170, adapter block 190 is generally rectangular in cross section. The distance between parallel sidewalls 194 is slightly less than the outer diameter of the primary projections on the toy building blocks. The distance between parallel sidewalls 192 is greater than the distance between parallel sidewalls 194 and is slightly less than the distance between the outside of two primary projections in a single row or line. The height of sidewalls 192 and 194 is not less than twice the height of the primary projections on the toy blocks and, preferably, is substantially one half of the height of the sidewalls of the standard toy building blocks.

Figure 41:
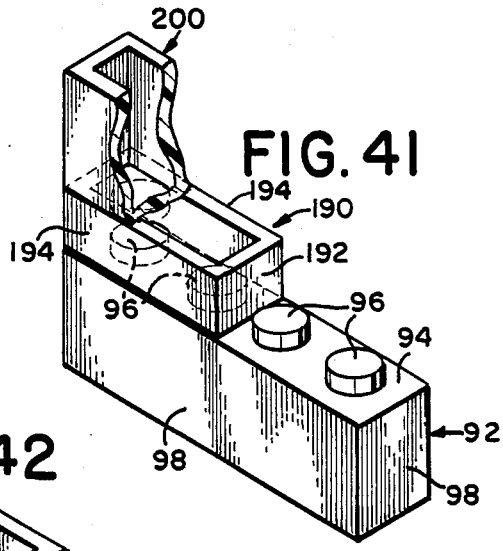
FIG. 41 is a top perspective view of the block of FIG. 16 interconnected with a 1×2 toy building block (partially broken away) utilizing the adapter block of FIG. 28.

FIGS. 41 and 42 illustrate the use of the 1×2 top-to-top adapter block 190. In FIG. 41, the adapter block 190 is interconnecting a standard 1×2 block 200 with a standard 1×4 block 92. Since the distance between parallel sidewalls 192 is slightly less than the distance between the outer ends of two of the primary projections 96 on the 1×4 block 92, the primary projections each engage both of sidewalls 194 and one of sidewalls 192 to provide a gripping force for holding the adapter block 190 and the 1×4 block 92 together. The adapter block 190 and the 1×2 block are similarly held together to thereby interconnect the 1×4 block 92 with the 1×2 block in a top-to-top manner, with their respective top or first ends facing each other. Interconnection of the 1×2 block 200 with the 2×4 block 104 as shown in FIG. 42 is accomplished in substantially the same manner.

Figure 29:
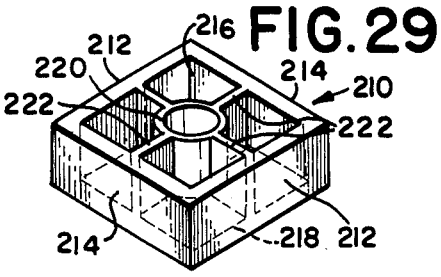
FIG. 29 is a top perspective view of an adapter block which is a second variation of the adapter block of FIG. 27.

FIG. 29 shows a 4×4 top-to-top adapter block 210 in accordance with a second variation of the second embodiment of the present invention. Adapter block 210 is also generally square in plan view and is comprised of two interconnected pairs of generally parallel sidewalls 212 and 214 which define first and second generally open ends 216 and 218. The sidewalls 212 and 214 are substantially the same length with substantially the same distance between each pair. As with the other top-to-top adapter blocks 170 and 190, the sidewalls 212 and 214 of adapter block 210 are not less than twice the height of the primary projections on the toy building block and preferably are substantially one half of the height of the standard toy building block sidewalls.

Although adapter block 210 could function as thusfar described (i.e., a hollow member generally square in cross section), the block 210 further includes a generally cylindrical member 220 positioned substantially in the center thereof and generally parallel to the sidewalls 212 and 214. In the presently preferred embodiment, the cylindrical projection 220 is supported by walls, preferably four flange members 222 which extend inwardly from the approximate midpoint of each of the sidewalls 212 and 214. Preferably, the cylindrical projection 220 and each of the flange members 222 are substantially the same height as the sidewalls 212 and 214. It is also presently preferred that the cylindrical member 220 be tubular as illustrated. The cylindrical member 220 and the flange members 222 cooperate with the sidewalls 212 and 214 to divide the adapter block 210 into four individual quadrants. The dimension of each quadrant are such that the sidewalls 212 and 214, flange members 222 and cylindrical member 220 provide a gripping force when surrounding and engaging a primary projection on a toy building block.

Figure 39:
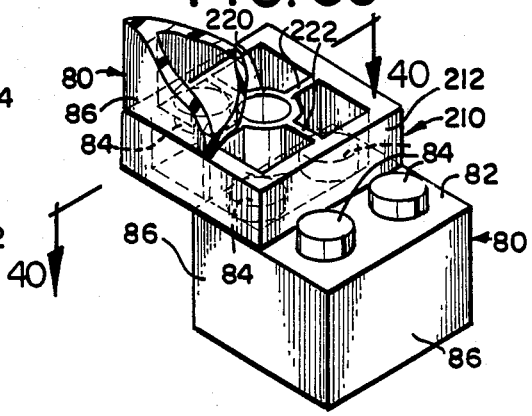
FIG. 39 is a top perspective view of two of the blocks of FIG. 13 (partially broken away) interconnected with the adapter block of FIG. 29.
Figure 40:
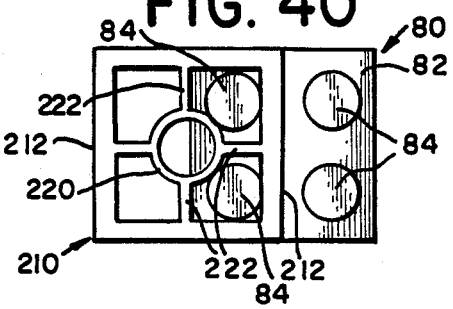
FIG. 40 is a sectional view of the interconnected blocks of FIG. 39 taken along line 40—40 of FIG. 39.

FIGS. 39 and 40 show the 2×2 top-to-top adapter block 210 in use with two standard 2×2 blocks 80 the upper 2×2 block partially broken away. Specifically, FIG. 40 shows the manner in which the adapter block 210 grips the primary projections 84 on the 2×2 blocks to interconnect the two blocks top to top with their respective first ends facing each other. As illustrated in FIGS. 39 and 40, the adapter block 210 is offset from the lower 2×2 block 80. However, the adapter block 210 could be aligned with the 2×2 block 80 if desired.

From the foregoing description, it can be seen that the present invention comprises an adapter block for permitting toy building blocks to be interconnected in a manner which is different from the usual or normal manner in which they are interconnected. One embodiment of the present invention permits the toy building blocks to be connected bottom to bottom and another embodiment of the present invention permits the blocks to be interconnected top to top. It will be recognized by those skilled in the art that changes may be made to the above-described embodiments of the invention without departing from the broad inventive concepts thereof. It is understood, therefore, that this invention is not limited to the particular embodiments disclosed, but it is intended to cover all modifications which are within the scope and spirit of the invention as defined by the appended claims.

I claim:

1. An adapter for interconnecting hollow toy building blocks, each block including a first end having an end wall with an inner surface and an outer surface which includes at least one generally cylindrical primary projection extending outwardly therefrom and sidewalls extending generally outwardly from and encompassing the inner surface to define a second generally open end, some of the blocks including at least one generally cylindrical secondary projection extending outwardly from the inner surface of the first end wall, generally parallel to the sidewalls, the blocks being normally interconnected with the first end of one block engaging the second end of another block, the primary projection of the one block extending into the open second end of the other block and engaging at least one of the sidewalls, the secondary projection, or both, on the other block to provide a gripping force for holding the blocks together, the adapter comprising a housing generally square in cross section and including at least two interconnected pairs of generally parallel sidewalls defining first and second generally open ends, the sidewalls having a height not less than twice the height of the primary projections on the blocks, the adapter further including at least one generally cylindrical tubular member extending along an axis generally parallel to said sidewalls, said tubular members being of substantially the same height as the housing sidewalls and being positioned substantially within the center of the housing, the cylindrical tubular member being supported by at least two flange members extending inwardly from two of the sidewalls and each of said flanges extending generally parallel to one of the sidewalls, whereby the first housing end is adapted for engaging the first end wall of one block with the primary projection on the one block extending into the housing and engaging with an interference fit two of the housing sidewalls and the cylindrical tubular member to provide three points of contact between the primary projection on the one block and the adapter, and the second housing end is adapted for engaging the first end wall of another block with the primary projection on the other block extending into the housing and engaging with an interference fit two of the housing sidewalls and the cylindrical tubular member to provide three points of contact between the primary projection on the other block and the adapter to interconnect the blocks with their respective first end walls facing each other, the cylindrical tubular member being formed so that the cylindrical tubular member rather than the housing sidewalls may deflect radially inwardly when engaged by one or more of the primary projections.

2. The adapter as recited in claim 1 wherein each of the housing sidewalls has a lateral center and wherein the cylindrical tubular member is supported by four flange members, one flange member extending inwardly from the lateral center of each of the housing sidewalls, the flange members being substantially the same height as the housing sidewalls.

* * * * *